US005903920A

United States Patent [19]

Granqvist

[11] Patent Number: 5,903,920

[45] **Date of Patent: *May 18, 1999**

[54] GARMENT FOR PERSONAL PROTECTION

[75] Inventor: Kaj Granqvist, Täby, Sweden

[73] Assignee: Safeboard AB, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/926,551

[22] Filed: Sep. 10, 1997

Related U.S. Application Data

[63] Continuation of application No. 08/615,776, Mar. 14, 1996, abandoned.

[30] Foreign Application Priority Data

Dec. 29, 1995 [SE] Sweden ..... 9504706

[51] Int. Cl.[6] ..... F41H 1/02; F41H 1/04

[52] U.S. Cl. ..... 2/2.5; 428/911

[58] Field of Search ..... 2/2.5; 428/911

[56] References Cited

U.S. PATENT DOCUMENTS

| | | | |
|---|---|---|---|
| 1,203,916 | 11/1916 | Schwarz | 2/2.5 |
| 2,697,054 | 12/1954 | Dietz et al. | 2/2.5 |
| 3,988,780 | 11/1976 | Armellino | 2/2.5 |
| 4,079,464 | 3/1978 | Roggin | 2/2.5 |
| 4,111,097 | 9/1978 | Lasker | 428/911 |
| 4,507,353 | 3/1985 | Kuhlmann et al. | 2/2.5 |
| 4,678,702 | 7/1987 | Lancster et al. . | |
| 4,681,792 | 7/1987 | Harpell et al. . | |
| 4,850,050 | 7/1989 | Droste et al. | 2/2.5 |
| 5,254,383 | 10/1993 | Harpell et al. . | |
| 5,472,769 | 12/1995 | Goerz, Jr. et al. | 2/2.5 |

FOREIGN PATENT DOCUMENTS

| | | | |
|---|---|---|---|
| 0 597 165 A1 | 5/1994 | European Pat. Off. . | |
| 3515726 | 11/1986 | Germany | 2/2.5 |
| 459884 | 8/1989 | Sweden . | |
| 470340 | 1/1994 | Sweden . | |
| 503 294 | 5/1996 | Sweden . | |
| 9404070 | 5/1996 | Sweden . | |
| 2232063 | 12/1990 | United Kingdom . | |
| WO 87/03674 | 6/1987 | WIPO . | |
| WO 96/13696 | 5/1996 | WIPO . | |

OTHER PUBLICATIONS

WO 92/06840; PCT Document, Reinforced Soft and Hard Body Armor, Zufle.

Technische Richtlinie für Leichte Schutzwesten, Nov. 1993 Schweizerische Polizeitechnische Komission (Zurich), title p. (1) through p. 7 and test page.

*Primary Examiner*—Bibhu Mohanty

*Attorney, Agent, or Firm*—Frishauf, Holtz, Goodman, Langer & Chick

[57] ABSTRACT

A garment for personal protection against both shots from firearms and stabs from stabbing weapons, wherein the garment comprises an outer covering, an inner covering, and a shot-absorbing unit located between the outer covering and the inner covering. The shot-absorbing unit includes: (i) a plurality of first layers of woven fibers with different mesh sizes, the first layers being flexibly fixed relative to one another and being positioned in mutually different directions, (ii) a plurality of second layers of woven fibers with different mesh sizes, the second layers being flexibly fixed relative to one another and being positioned in mutually different directions, and (iii) at least one intermediate member provided between the first layers and the second layers, the intermediate member being flexibly fixed relative to at least one of the first layers and having mutually interlinked and at least partially mutually movable rings which are made of a material which is capable of resisting sharp objects. The first and second layers of the shot-absorbing unit are placed in a direction of potential incidence of a bullet and a stabbing weapon, with the first layers being positioned closest to the outer covering and the second layers being positioned closest to the inner covering. The second layers are greater in number than the first layers and a total number of the first and second layers and a density of each of the first and second layers are such that the garment has as light a weight and as thin a size as possible and such that the garment maintains relative flexibility in order to thereby be adaptable to and accompany movements of a wearer without obstructing the wearer in any essential respect.

19 Claims, 1 Drawing Sheet

GARMENT FOR PERSONAL PROTECTION

This application is a continuation of application Ser. No. 08/615,776, filed Mar. 14, 1996 now abandoned.

TECHNICAL FIELD

The present invention relates to a garment for personal protection against both shots from firearms and stabs from stabbing weapons or the like. The garment is made relatively flexible in order to thereby be adaptable to and accompany the movements of the body without obstructing such movements in any essential respect. In weight and size the garment is designed to be as light and thin as possible. The garment appropriately incorporates an outer covering and an inner covering, between which a shot absorbing unit is located.

BACKGROUND ART

Garments designed to achieve personal protection against attack with, especially, firearms are previously known in a number of embodiments. The known garments are heavy and clumsy to handle and wear, since as a rule they make use of rigid plates or the like so as also to be able to provide protection against stabbing weapons of, for example, the knife type.

OBJECT OF THE INVENTION

The object of the present invention is to provide a garment for personal protection against both firearms and stabbing weapons, wherein the garment is of low weight and soft and thereby pliable to the body movements of the wearer.

The above tasks and objects have been solved in accordance with the present invention by means of a garment having a shock absorbing unit which incorporates a relatively large number of layers of woven fibres, preferably with different mesh sizes, said layers being located in mutually different directions and flexibly fixed relative to one another. A relatively small number of layers of woven fibres, preferably with different mesh sizes, are provided which are located in mutually different directions and flexibly fixed relative to one another. In addition at least one net is located between said layers, said net being flexibly fixed relative to said layers and made of a material which in itself is capable of resisting sharp objects. The layers are positioned in a direction of incidence for a bullet, a knife, etc. with the small number of layers first and thereafter the said at least one net and thereafter the said large number of layers.

A particularly advantageous effect is achieved if said layers incorporate woven fibers of type aramide and said net incorporates mutually interlinked rings consisting of metal and/or ceramic and if said layers and said net are mutually flexibly fixed by means of knitting and/or by means of stitching, preferably in the form of an X.

BRIEF DESCRIPTION OF THE ACCOMPANYING DRAWINGS

The present invention will be described in greater detail hereinbelow, with particular reference to an embodiment chosen by way of example and with particular reference to the accompanying drawing, wherein FIG. 1 shows a perspective view of outer and inner coverings for a personal protection halved for the sake of clarity;

FIG. 2 shows the garment according to FIG. 1 completely formed as a vest for personal protection; and FIG. 3 shows an enlargement of the principle construction of a unit located between the coverings according to FIG. 1, the details of which will be described in greater detail hereinbelow with reference to an embodiment chosen by way of example.

DETAILED DESCRIPTION

Figure 1:
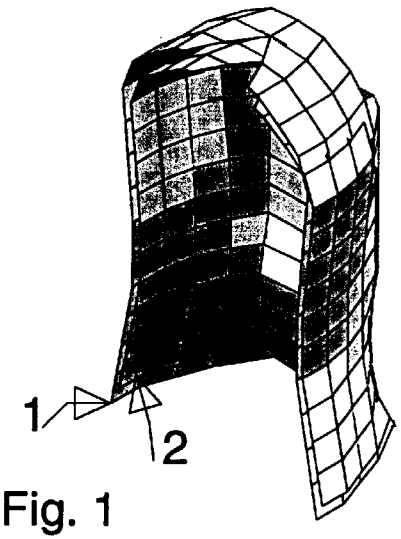

As shown in FIG. 1, the personal protection incorporates an outer covering 1 and an inner covering 2. The coverings 1 and 2 include a wear resistant and abrasion resistant, soft and flexible material, for example fabric, hide, etc., which beneficially is also made flameproof. Applied between the coverings 1 and 2 is a flexible unit 3, which is illustrated as enlarged and simplified in FIG. 3 and which is described in greater detail hereinbelow.

Figure 2:
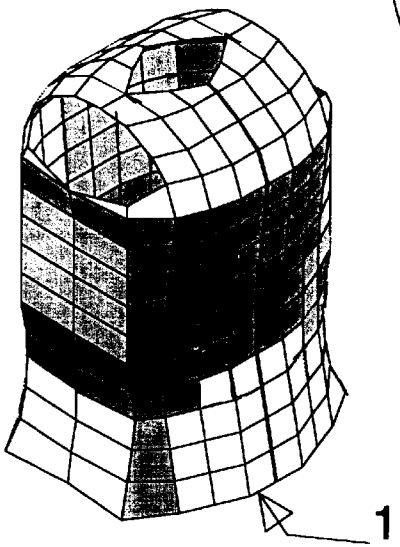

A complete specimen of a personal protection chosen by way of example is illustrated in FIG. 2 in the form of a flexible vest, the outer covering of which is marked with reference numeral 1 in the Figure. Other embodiments of the personal protection are naturally fully possible. For example the vest according to FIG. 2 can be supplemented with additional front protection, with arm protection, with collar protection etc., all according to the needs and wishes in the particular case concerned.

Figure 3:
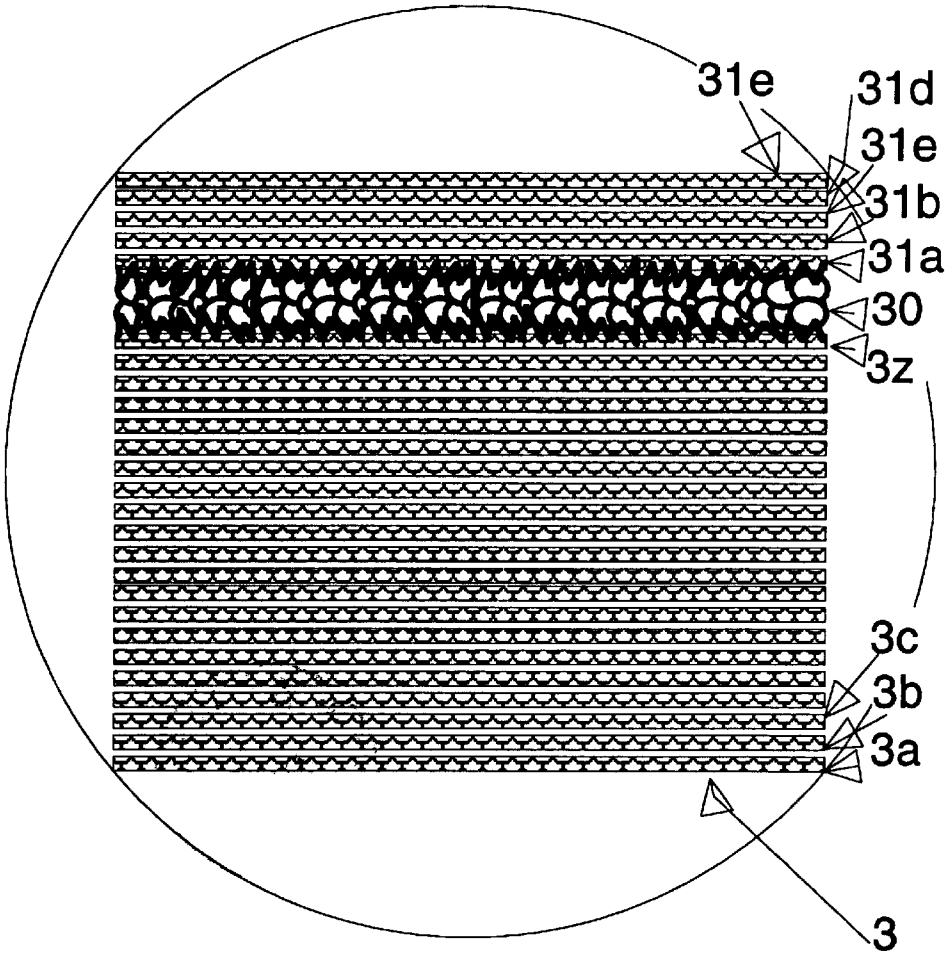

FIG. 3 shows an enlargement of the fundamental construction of a unit 3 located between the coverings 1 and 2 according to FIGS. 1–2.

The said unit 3 incorporates first and foremost a large number 3*a*–3*z* of layers of woven fibres, made of, for example, aramide or the like and preferably woven with different mesh sizes in the different layers, said layers being located in mutually different directions and being flexibly fixed relative to one another, for example by means of knitting or sewing. The number of layers 3*a*–3*z* is 20 or more, for example 28.

The said unit 3 also incorporates a small number 31*a*–31*e* of layers of woven fibres, made of, for example, aramide or the like and preferably woven with different mesh sizes in the different layers, said layers being located in mutually different directions and being flexibly fixed relative to one another, for example by means of knitting or sewing. The number of layers 31*a*–31*e*is in this case 6 or fewer, for example 4.

Located between said layers 3*a*–3*z* and 31*a*–31*e* is a net 30, which is flexibly fixed to both layers 3*a*–3*z* and 31*a*–31*e*, for example by means of knitting or sewing, as indicated in principle in FIG. 3 with deep black, irregular dashes. The said net 30 may include ring mesh, i.e. of rings which are able to move relative to one another but which are mutually interlinked. The said rings may include, for example, stainless steel, titanium, ceramics or any other suitable material or material combination, which primarily resists sharp objects such as knife tips, without breaking apart or breaking off.

Said unit 3 with the layers 31*e*–31*a*, the net 30 and the layers 3*z*–3*a* according to FIG. 3 has a direction of impact for a gun or stab weapon from above and down as seen in said FIG. 3. In other words, the layers 31*e*–31*a* are positioned closest to the outer covering 1 and the layers 3*a*–3*z* are positioned closest to the inner covering 2 as seen in FIGS. 1 and 2.

A manufacturing procedure selected only by way of example will now be described in greater detail. Cut out layers 31*a*–31*e*and a cut out net 30 are sewn or knitted together with the knitting or the sewing in the form of an X. The layers 3*a*–3*z* are then placed on the net 30 and on the layers 31*a*–31*e*and sewn together, again with the sewing in the form of an X. A thuswise manufactured unit 3 is adapted during the cutting out and joining together so that it can be introduced between the coverings 1 and 2 and fit, for example, in one half of the personal protection garment. For example, the unit 3 may be fit in the front or the back of the vest, respectively, between the coverings 1 and 2, which are then sewn together. By this means the unit will be located between the coverings 1 and 2 and retained by the coverings, whereas the layers. 31*a*–31*e*, the net 30 and the layers 3*a*–3*z* are not fixed along their edges but are fixed diagonally relative to one another in the aforesaid X shape, for example, from the shoulder to the hip of the wearer on both the front and the back of the vest. By this means great flexibility and mobility of the vest is obtained when the wearer of the vest moves.

An alternative manufacturing procedure can include the layers and the net being elastically joined together instead of being joined by sewing or knitting, with the aid of a suitable elastic bonding agent such as silicon or polyurethane glue.

Obviously it also lies within the scope and spirit of the invention to apply more than one net 30 as above if it should be desired or needed, and also to vary the number of layers.

I claim:

1. A garment for personal protection against both shots from firearms and stabs from stabbing weapons, said garment comprising:

an outer covering;

an inner covering; and a shot-absorbing unit located between said outer covering and said inner covering, said shot-absorbing unit including: (i) a plurality of first layers of woven fibers with different mesh sizes, said first layers being flexibly fixed relative to one another and being positioned in mutually different directions, (ii) a plurality of second layers of woven fibers with different mesh sizes, said second layers being flexibly fixed relative to one another and being positioned in mutually different directions, and (iii) at least one intermediate member provided between said first layers and said second layers, said intermediate member being flexibly fixed relative to at least one of said first layers and having mutually interlinked and at least partially mutually movable rings which are made of a material which is capable of resisting sharp objects;

wherein said first and second layers of said shot-absorbing unit are placed in a direction of potential incidence of a bullet and a stabbing weapon, with said first layers being positioned closest to said outer covering and said second layers being positioned closest to said inner covering; and wherein said second layers are greater in number than said first layers and wherein a total number of said first and second layers and a density of each of said first and second layers are such that the garment has as light a weight and as thin a size as possible and such that the garment maintains relative flexibility in order to thereby be adaptable to and accompany movements of a wearer without obstructing the wearer in any essential respect.

2. The garment according to claim 1, wherein said inner and outer coverings are made of a flameproof fabric material, said first and second layers comprise woven fibers of aramid, and said intermediate member comprises a net having mutually interlinked and movable mesh rings which are made of at least one of metal and ceramic.

3. The garment according to claim 1, wherein said first layers and said intermediate member are flexibly fixed relative to one another in the form of an X by means of at least one of knitting and sewing.

4. The garment according to claim 2, wherein said first layers and said net are flexibly fixed relative to one another in the form of an X by means of at least one of knitting and sewing.

5. The garment according to claim 1, wherein said first layers are not more than six in number, and said second layers are at least twenty in number.

6. The garment according to claim 2, wherein said first layers are not more than six in number, and said second layers are at least twenty in number.

7. The garment according to claim 3, wherein said first layers are not more than six in number, and said second layers are at least twenty in number.

8. The garment according to claim 4, wherein said first layers are not more than six in number, and said second layers are at least twenty in number.

9. The garment according to claim 1, wherein said second layers are more than four times in number than said first layers.

10. The garment according to claim 2, wherein said second layers are more than four times in number than said first layers.

11. The garment according to claim 3, wherein said second layers are more than four times in number than said first layers.

12. The garment according to claim 4, wherein said second layers are more than four times in number than said first layers.

13. The garment according to claim 5, wherein said second layers are more than four times in number than said first layers.

14. The garment according to claim 1, wherein said first layers are four in number and said second layers are twenty-eight in number.

15. The garment according to claim 2, wherein said first layers are four in number and said second layers are twenty-eight in number.

16. The garment according to claim 3, wherein said first layers are four in number and said second layers are twenty-eight in number.

17. The garment according to claim 4, wherein said first layers are four in number and said second layers are twenty-eight in number.

18. A garment for personal protection against both shots from firearms and stabs from stabbing weapons, said garment comprising:

an outer covering;

an inner covering; and a shot-absorbing unit located between said outer covering and said inner covering, said shot-absorbing unit including: (i) a plurality of first layers of woven fibers, said first layers being flexibly fixed relative to one another, (ii) a plurality of second layers of woven fibers, said second layers being flexibly fixed relative to one another, and (iii) at least one intermediate member provided between said first layers and said second layers, said intermediate member being flexibly fixed relative to at least one of said first layers and having mutually interlinked and at least partially mutually movable rings which are made of a material which is capable of resisting sharp objects;

wherein said first and second layers of said shot-absorbing unit are placed in a direction of potential incidence of a bullet and a stabbing weapon, with said first layers being positioned closest to said outer covering and said second layers being positioned closest to said inner covering; and wherein said second layers are greater in number than said first layers and wherein a total number of said first and second layers and a density of each of said first and second layers are such that the garment has as light a weight and as thin a size as possible and such that the garment maintains relative flexibility in order to thereby be adaptable to and accompany movements of a wearer without obstructing the wearer in any essential respect.

19. A garment for personal protection against both shots from firearms and stabs from stabbing weapons, said garment comprising:

an outer covering;

an inner covering; and a shot-absorbing unit located between said outer covering and said inner covering, said shot-absorbing unit including: (i) a plurality of first flexible layers being flexibly fixed relative to one another, (ii) a plurality of second layers of woven fibers, said second layers being flexibly fixed relative to one another, and (iii) at least one intermediate member provided between said first layers and said second layers, said intermediate member being flexibly fixed relative to at least one of said first layers and/or at least one of said second layers, and said intermediate member having mutually interlinked and at least partially mutually movable rings which are made of a material which is capable of resisting sharp objects;

wherein said first and second layers of said shot-absorbing unit are placed in a direction of potential incidence of a bullet and a stabbing weapon, with said first layers being positioned closest to said outer covering and said second layers being positioned closest to said inner covering; and wherein said second layers are greater in number than said first layers and wherein a total number of said first and second layers and a density of each of said first and second layers are such that the garment has as light a weight and as thin a size as possible and such that the garment maintains relative flexibility in order to thereby be adaptable to and accompany movements of a wearer without obstructing the wearer in any essential respect.

* * * * *